US012497678B2

(12) United States Patent
Bertrand et al.

(10) Patent No.: US 12,497,678 B2
(45) Date of Patent: Dec. 16, 2025

(54) ANNEALING METHOD

(71) Applicant: ArcelorMittal, Luxembourg (LU)

(72) Inventors: Florence Bertrand, Scy-Chazelles (FR); Didier Huin, Nancy (FR); Hubert Saint-Raymond, Metz (FR)

(73) Assignee: ArcelorMittal, Luxembourg (LU)

( * ) Notice: Subject to any disclaimer, the term of this patent is extended or adjusted under 35 U.S.C. 154(b) by 377 days.

(21) Appl. No.: 18/265,863

(22) PCT Filed: Dec. 8, 2021

(86) PCT No.: PCT/IB2021/061436
§ 371 (c)(1),
(2) Date: Jun. 7, 2023

(87) PCT Pub. No.: WO2022/130124
PCT Pub. Date: Jun. 23, 2022

(65) Prior Publication Data

US 2024/0026487 A1 Jan. 25, 2024

(30) Foreign Application Priority Data

Dec. 15, 2020 (WO) ..... PCT/IB2020/061960

(51) Int. Cl.
*C23C 2/02* (2006.01)
*C21D 9/46* (2006.01)
(Continued)

(52) U.S. Cl.
CPC ..... *C23C 2/0224* (2022.08); *C21D 9/46* (2013.01); *C22C 38/02* (2013.01); *C22C 38/04* (2013.01); *C23C 2/0038* (2022.08)

(58) Field of Classification Search
CPC ..... C21D 1/74; C21D 1/76; C21D 8/0273; C21D 8/0473; C21D 8/1272; C21D 9/561; C21D 9/67; C23C 2/0038; C23C 2/02; C23C 2/022; C23C 2/0222; C23C 2/0224; C23C 2/04; C23C 2/06; C23C 2/08;
(Continued)

(56) References Cited

U.S. PATENT DOCUMENTS

2003/0091857 A1 5/2003 Pradhan et al.
2009/0123651 A1* 5/2009 Okada ..... C23C 2/06 427/319
(Continued)

FOREIGN PATENT DOCUMENTS

CN 111826511 A * 10/2020 ..... C23C 2/06
EP 1936000 A1 6/2008
(Continued)

OTHER PUBLICATIONS

Search Report of PCT/IB2021/061436 of Feb. 23, 2022 and International Report on Patentability.

*Primary Examiner* — Vanessa T. Luk
(74) *Attorney, Agent, or Firm* — Davidson Kappel LLC

(57) ABSTRACT

A method for the manufacture of a steel sheet, in a device including a pre-heating section, a heating section having a maximal heating rate and a soaking section including a calibrating step, a recrystallization annealing and a soaking and a coating step. The calibration step permits to define a lower dew point permitting to achieve a predefined quality target.

18 Claims, 3 Drawing Sheets

(51) Int. Cl.

| | |
|---|---|
| ***C22C 38/02*** | (2006.01) |
| ***C22C 38/04*** | (2006.01) |
| ***C23C 2/00*** | (2006.01) |

(58) Field of Classification Search
CPC .... C23C 2/10; C23C 2/12; C23C 2/50; C23C 2/51; C23C 2/52
See application file for complete search history.

(56) References Cited

U.S. PATENT DOCUMENTS

| | | | |
|---|---|---|---|
| 2017/0260599 | A1 | 9/2017 | Puerta Velasquez et al. |
| 2021/0017620 | A1 | 1/2021 | Yokohama et al. |
| 2021/0156018 | A1 | 5/2021 | Debeaux et al. |

FOREIGN PATENT DOCUMENTS

| | | | |
|---|---|---|---|
| EP | 3378965 | A1 | 9/2018 |
| JP | H0860322 | A | 3/1996 |
| WO | WO2017182833 | A1 | 10/2017 |
| WO | WO2019154680 | A1 | 8/2019 |
| WO | WO2019187060 | A1 | 10/2019 |
| WO | WO2020064096 | A1 | 4/2020 |

* cited by examiner

A B

ANNEALING METHOD

The present invention relates to a manufacturing method of a steel sheet.

BACKGROUND

During their manufacture, before being coated, full hard steels are annealed to increase their strength-ductility balance. During the annealing, the steel sheet is heated and maintained above its recrystallization temperature in a controlled atmosphere. Then the steel band is cooled and coated, usually by hot dip in a galvanizing bath.

For example, a common practice is to heat the full hard steel sheet from ambient temperature to temperature above the recrystallisation point of the steel (heating step) and then hold the steel at this temperature (soaking step). Both steps are conducted in the same atmosphere and at the same dew point, e.g.: an atmosphere comprising 5% by volume of $H_2$ along an inert gas and a dew point between −40° C. and +10° C.

In the heating step, the gradual increase of temperature along with the presence of oxygen leads to the diffusion of the oxygen into the steel which leads to two types of reactions. Firstly, oxygen reacts with the carbon and form gases, such as $CO_2$ and CO, leading to a depletion of carbon atoms in the steel subsurface. However, in the meantime, carbon atoms from the bulk diffuses into the carbon depleted zone. As long as more carbon atoms leave the subsurface layer than carbon atoms enter said layer, the subsurface layer will be decarburized. Secondly, oxygen reacts with the steel alloying elements, such as Manganese (Mn), Aluminium (Al), Silicon (Si) or Chromium (Cr), having a higher affinity towards oxygen than iron. It leads to the formation of oxides at the steel subsurface. The formation of said oxides in the subsurface reduces the amount of alloying element available to form surface oxides.

In the soaking step, as compared to the heating step, the temperature is higher. Due to a higher temperature in the soaking section, alloying elements which have not form any internal oxides can diffuse from the bulk to the steel surface and may form external selective oxide which is believed to negatively influence the steel wettability.

In a subsequent process step, these steels are usually coated by a metallic alloy, such as a zinc-based coating, to improve their properties such as corrosion resistance and/or phosphatability. The metallic coatings can be deposited by hot-dip method or electroplating method.

SUMMARY OF THE INVENTION

In the state of the art, it is believed that the external selective oxides formed by the steel alloying elements on the steel sheet surface during the annealing step, prevents the reactive wetting between the substrate, i.e. the steel, and the coating, i.e. the aluminium- or zinc-based coatings. Consequently, a discontinuous and non-uniform inhibition layer is formed. This can result in areas comprising no coating on the final product, e.g. bare spot, or problems related to the delamination of the coating which is detrimental for the product quality.

In EP 3 378 965 A1, a manufacturing method of a high-strength hot-dip galvanized steel sheet excellent in impact resistance and worked portion corrosion resistance is described. The heating step is done up to 650° C. in an atmosphere containing $H_2$ for 0.1 to 20 volume percent and satisfying the following condition: $-1.7 \leq \log(PH_2O/PH_2) \leq -0.6$. Such parameters correspond to a dew point between −20° C. and +10° C. for a $H_2$ concentration of 5%. The temperature rise rate is of 0.5 to 5° $C.s^{-1}$. The steel sheet temperature rise is limited to 5° $C.s^{-1}$ because otherwise, the recrystallization at the steel sheet base material surface layer proceeds before formation of the internal oxide particles and also because the decarburized layer cannot be obtained timewise.

One goal of the present invention is to increase the reliability of an annealing process and improve the wettability of a steel substrate and the quality of the coating.

The invention relates to a method for the manufacture of a steel sheet having a thickness t, in a device comprising a pre-heating section, a heating section having a maximal heating rate for a steel sheet having a thickness t and a soaking section, the method comprising:

A) A calibration step wherein
- i) a steel sheet having a thickness t and the following chemical composition in weight percent: 0.05≤C≤0.50%, 0.3≤Mn≤8.0%, 0.01≤Si≤5%, and optionally at least one of the following elements, in weight percent: 0.01≤Al≤1.5%, B≤0.004%, Co≤0.1%, 0.001≤Cr≤1.00%, Cu≤0.5%, 0.001≤Mo≤0.5%, Nb≤0.1%, Ni≤1.0%, Ti≤0.1%, N≤0.01%, P<0.1%, S≤0.01%, V<0.2%, the remainder of the composition being made of iron and inevitable impurities, is heated from room temperature to a temperature $T_1$ lower than 600° C.,
- ii) said steel sheet is heated from $T_1$ to a recrystallisation temperature $T_2$ in the range of 720° C. to 1000° C. at said maximal heating rate, in an atmosphere $A_1$ comprising 0.1 to 90% by volume of Hz, the balance being an inert gas and unavoidable impurities and having a dew point $DP_{CAL}$,
- iii) said steel sheet is then maintained at a temperature $T_2$, in an atmosphere $A_2$, comprising 0.1 to 90% by volume of Hz, the balance being an inert gas and unavoidable impurities and having a dew point of at least −40° C.,
- iv) said steel sheet is then hot-dip coated and the quality of said coating is assessed,
- v) a) if said coating quality is meeting a predefined quality target, repeating said calibration steps i) to iv) with a lower dew point $DP_{CAL}$, until said coating quality is not meeting said target anymore, the penultimate dew point $DP_{CAL}$ being defined as $DP_1$
- b) if said coating quality is not satisfying, repeating said calibration steps i) to v) with a higher dew point $DP_{CAL}$, until said coating quality meets said target, the ultimate $DP_{CAL}$ being defined as $DP_1$ B) A production step wherein a steel sheet with said thickness t and said chemical composition undergoes: a recrystallization annealing comprising successively a pre-heating step, a heating step, a soaking step and a cooling step wherein:
- i) said pre-heating step includes a heating from room temperature to a temperature T1 lower than 600° C.,
- ii) said heating step includes a heating from T1 to a recrystallisation temperature T2 in the range from 720° C. to 1000° C. at a heating rate being lower or equal to said maximal heating rate, in an atmosphere A1 comprising 0.1 to 90% by volume of H2, the balance being an inert gas and unavoidable impurities and having a dew point set at least at the $DP_1$ value determined during the calibration step, iii) said soaking step includes a holding at a temperature in the range from T2−30° C. to T2+30° C., in an atmosphere A2 comprising 0.1 to 90% by volume of H2, the balance being an inert gas and unavoidable impurities and having a dew point $DP_2$ set at −40° C. or more, a coating step wherein said steel sheet is hot dip coated.

BRIEF DESCRIPTION OF THE DRAWINGS

To illustrate the invention, various embodiment and trials of non-limiting example will be described, particularly with reference to the following figures.

DETAILED DESCRIPTION

Figure 1:
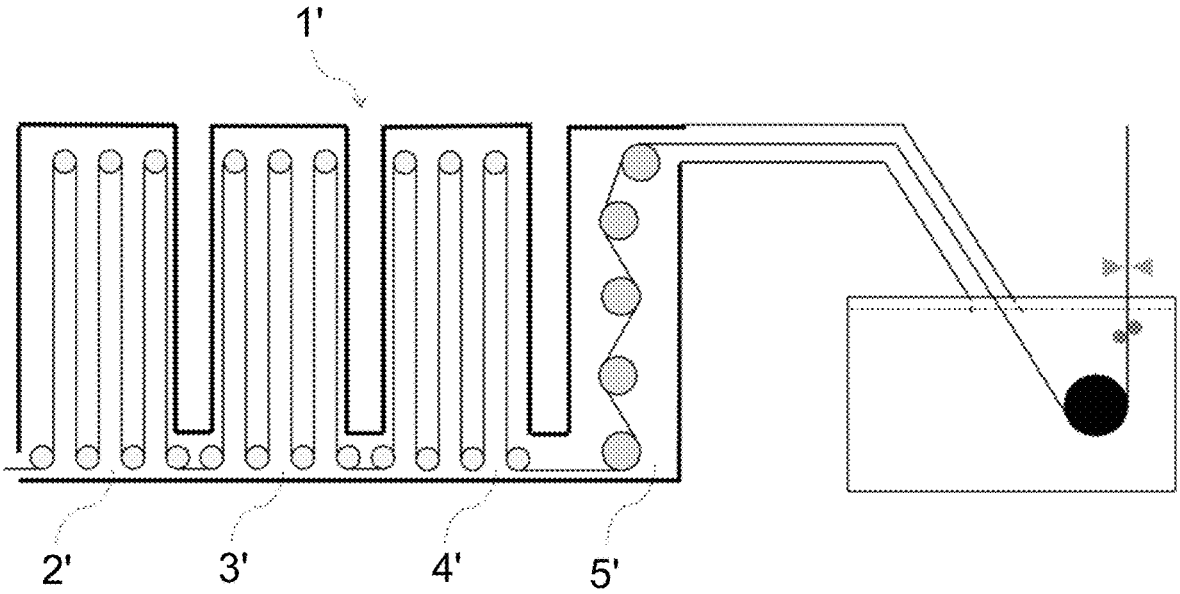
FIG. 1 illustrates an embodiment of an annealing furnace and a hot-dip coating installation.

As illustrated in FIG. 1, the device 1' is a device able to perform heat treatments, e.g. an annealing oven or an annealing furnace. Such a device comprises a pre-heating section 2', a heating section 3', a soaking section 4' and a cooling section 5' wherein the temperature, the heating rate and the atmosphere of those sections can be set and controlled.

The temperature of the steel sheet increases in the preheating and the heating section. The maximal heating rate of the heating section is the highest heating rate at which the manufactured steel sheet, having a thickness t, can be heated during the heating section in the production step ii). The maximal heating rate refers to an inherent maximal heating rate of said heating section for a steel sheet having a thickness t. The maximal heating rate relates to an average value.

The carbon content is from 0.05 to 0.50 weight percent. If the carbon content is below 0.05 weight percent, there is a risk that the tensile strength is insufficient. Furthermore, if the steel microstructure contains retained austenite, its stability which is necessary for achieving sufficient elongation, can be not obtained. If the carbon content is greater than 0.5 weight percent, hardenability of the weld increases.

The manganese content is from 0.3 to 8.0 weight percent. Manganese is a solid solution hardening element which contributes to obtain high tensile strength. Such effect is obtained when Mn content is at least 0.3 weight percent. However, when the Mn content is greater than 8.0 weight percent, it can contribute to the formation of a structure with excessively marked segregated zones which can adversely affect the welds mechanical properties. Preferably, the manganese content is from 1.5 to 5.0 weight percent. This makes it possible to obtain satisfactory mechanical strength without increasing the difficulty of industrial fabrication of the steel and without increasing the hardenability in the welds.

The silicon content is from 0.01 to 5 weight percent. Silicon delays the carbide formation and stabilizes the austenite. When the silicon content is greater than 5 weight percent, the plasticity and the toughness of the steel are significantly reduced.

The steels may optionally contain elements such as Al, B, Co, Cr, Cu, Mo, N, Nb, Ni, P, S, Ti, V for the following reasons:

Aluminium can optionally be contained in said steel sheet in a content from 0.01 to 1.5 weight percent. Al increases the Ms temperature and thus destabilises the retained austenite. In addition, with the increase of Al content above 1.5 weight percent, Ac3 temperature increases causing difficulty in industrial production. Preferably, the aluminium content is from 0.01 to 1.0 weight percent.

Boron can optionally be contained in said steel sheet in a content below or equal to 0.004 weight percent. By segregating at the grain boundary, B decreases the grain boundary energy and is thus beneficial for increasing the resistance to liquid metal embrittlement.

Chromium can optionally be contained in said steel sheet in a content below or equal 1.00 weight percent. Chromium permits to delay the formation of pro-eutectoid ferrite during the cooling step after holding at the maximal temperature during the annealing cycle, making it possible to achieve higher strength level. Its content is limited to 1.00 weight percent for cost reasons and to prevent excessive hardening.

Copper can optionally be contained in said steel sheet in a content below or equal 0.5 weight percent for hardening the steel by precipitation of copper metal.

Molybdenum can optionally be contained in said steel sheet in a content below or equal 0.5 weight percent. It is efficient for increasing the hardenability and stabilizing the retained austenite since this element delays the decomposition of austenite.

Nickel can optionally be contained in said steel sheet in a content below or equal 1.0 weight percent to improve the toughness.

Titanium can optionally be contained in said steel sheet in a content below or equal 0.1 weight percent. Niobium can optionally be contained in said steel sheet in a content below or equal 0.1 weight percent. They harden and strengthen the steel by forming precipitates. However, when the Nb amount is above 0.1 weight percent and/or Ti content is greater than 0.1 weight percent, there is a risk that an excessive precipitation may cause a reduction in toughness, which has to be avoided.

Vanadium can optionally be contained in said steel sheet in a content below or equal 0.2 weight percent. It forms precipitates hardening and strengthening the steel.

Phosphorus and Sulfur are considered as a residual element resulting from the steelmaking. P can be present in an amount below or equal to 0.04 weight percent. S can be present in an amount below or equal to 0.01 weight percent.

Preferably, the chemical composition of the steel does not include Bismuth (Bi). Indeed, without willing to be bound by any theory, it is believed that if the steel sheet comprises Bi, the wettability decreases and therefore the coating adhesion.

The calibration step is preferably done using the same device as the production step. However, it is possible to use different device for the calibration step and the production step. Preferably, the device of the calibration step is an annealing furnace.

In the iv) of the calibration step, the assessment of the coating quality can be done by visual inspection and/or inspection instruments, e.g. a Scanning Electron Microscope (SEM) or a Field Emission Gun Scanning Electron Microscopy (FEG-SEM).

In the v) of the calibration step, the predefined quality target is preferably linked to the coating homogeneity on the steel sheet. Preferably, the predefined quality target takes into account the absence of area without coating and/or the mean coating thickness and/or a percentage of coated area.

Figure 2:
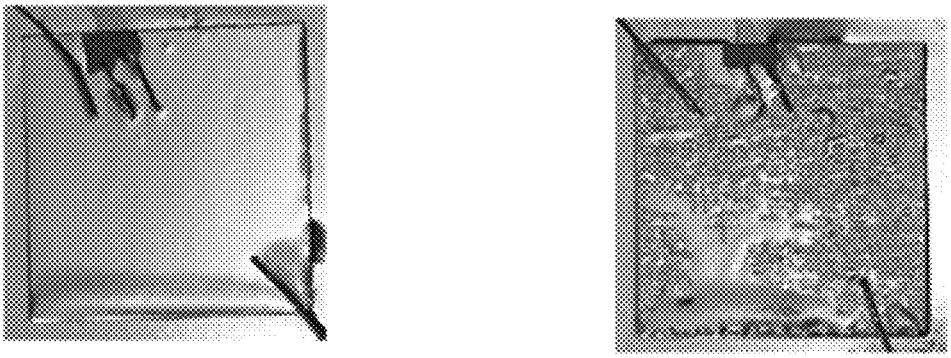
FIG. 2 illustrates an embodiment of a coating meeting the quality target (A) and of an embodiment of a coating not meeting the quality target (B).

For example, FIG. 2 exhibits two coating qualities: one satisfying on the left (A) and one not satisfying on the right (B). The one on the left is satisfying because the whole sample is coated with a uniform thickness. The one on the right is not satisfying because some areas of the sample are not coated.

Figure 3:
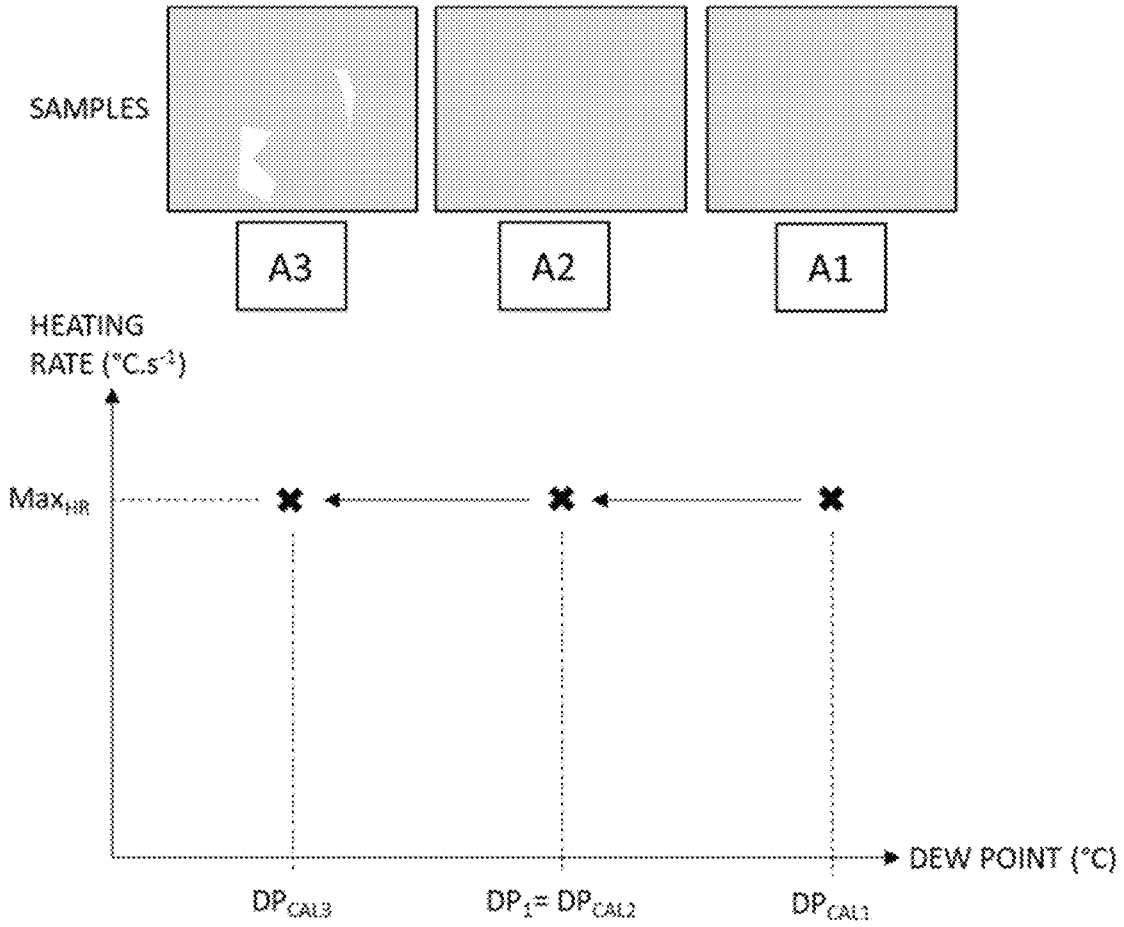
FIG. 3 embodies the step v)a) of the calibration step.

The iteration of the process described in the v)a) is illustrated in FIG. 3. A first sample "A1" has been produced, following the steps i) to iv), at a dew point $DP_{CAL1}$ and at the maximal heating rate (Max HR). The coating quality meets the predefined quality target because as illustrated on the sample "A1", the whole surface is coated (represented in grey). Then a second sample "A2" has been produced, following the steps i) to iv), at a dew point $DP_{CAL2}$ being lower than DP c Au and at the maximal heating rate ($Max_{HR}$). The coating quality meets the predefined quality target because as illustrated on the sample "A2", the whole surface is coated (represented in grey). Then a third sample "A3" has been produced, following the steps i) to iv), at a dew point $DP_{CAL3}$ being lower than $DP_{CAL2}$ and at the maximal heating rate ($Max_{HR}$). The coating quality does not meet the predefined quality target because as illustrated on the sample "A3", some area of the surface of the sample "A3" are not coated (represented in white). $DP_{CAL2}$ is thus defined as $DP_1$.

Preferably, in said step ii), $DP_{CAL}$ has a lowest value of −40° C. Even more preferably, in said step ii) of the calibration step A) $DP_{CAL}$ has a lowest value of −40° C. and in said step v)a), if said coating quality is met at a $DP_{CAL}$ of −40° C., −40° C. is being defined as DP1. Consequently, if a sample is produced using the maximal heating rate at a dew point of −40° C.) and meeting the predefined coating quality, −40° C. can be defined as $DP_1$.

Figure 4:
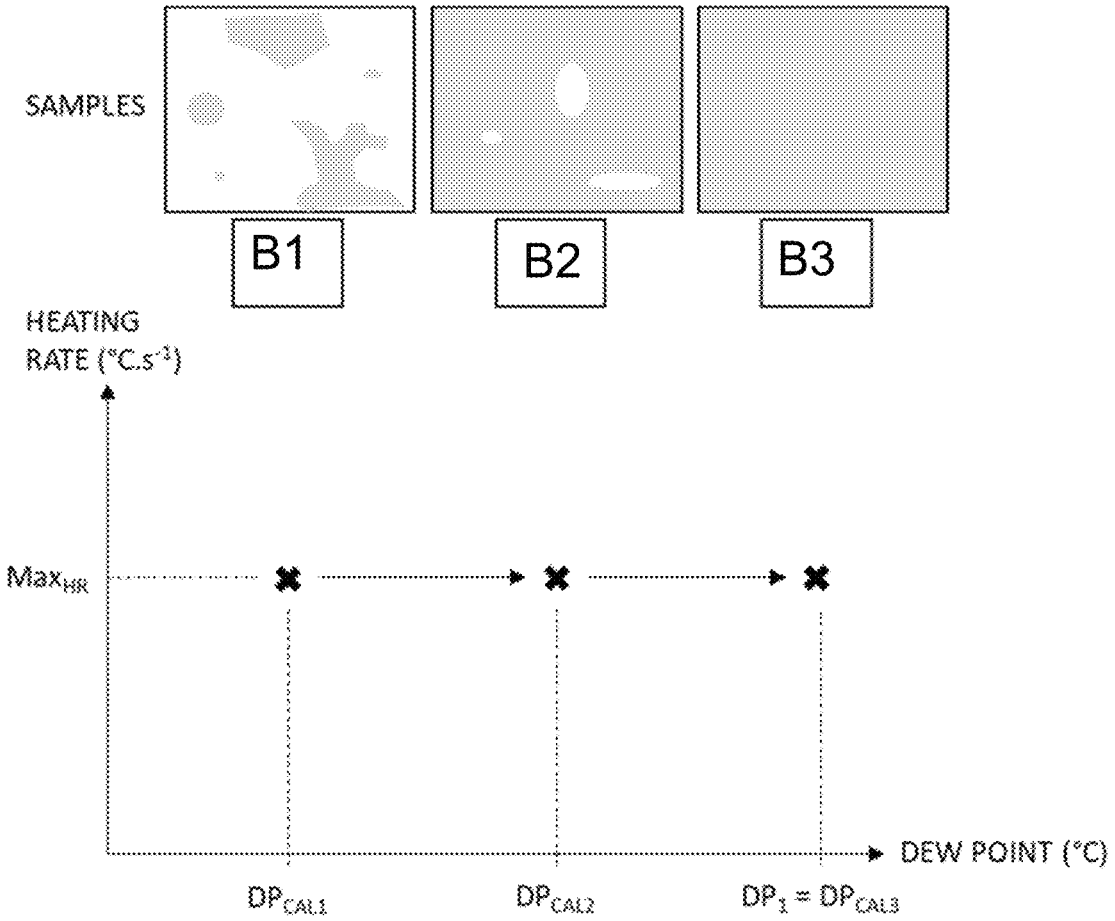
FIG. 4 embodies the step v)b) of the calibration step.

The iteration of the process described in the v)b) is illustrated in FIG. 4. A first sample "B1" has been produced, following the steps i) to iv), at a dew point $DP_{CAL1}$ and at the maximal heating rate ($Max_{HR}$). The coating quality does not meet the predefined quality target due to areas not being coated. Then a second sample "B2" has been produced, following the steps i) to iv), at a dew point $DP_{CAL2}$ being greater than DP c Au and at the maximal heating rate ($Max_{HR}$). The coating quality does not meet the predefined quality target due to areas not being coated. Then a third sample "B3" has been produced, following the steps i) to iv), at a dew point $DP_{CAL3}$ being greater than $DP_{CAL2}$ and at the maximal heating rate ($Max_{HR}$). The coating quality meets the predefined quality target. $DP_{CAL3}$ is thus defined as $DP_1$.

It has surprisingly been observed that a key driver for the wettability of a metallic coating is the relation between the heating rate and the dew point in the heating rate but not the process parameters of the soaking section, due to the formation of external oxides, contrary to what is believed in the state of the art.

Consequently, thanks to the calibration step, a limit dew point in the heating section ($DP_1$) can be defined from which a predefined coating quality is achieved for any heating rate in the heating zone.

The pre-heating step generally occurs after the steel has been cold-rolled. During this pre-heating, the steel sheet is heated from room temperature to a temperature T1 lower than 600° C. For example, this step can be done in a RTF (Radiant Tube Furnace) having an atmosphere made up of $N_2$, $H_2$ and unavoidable impurities, or by means of an induction device or in a DFF (Direct-Fired Furnace) having an atmosphere having an air/gas ratio<1. However, it is possible in a DFF comprising several zones, e.g. 5 zones, to have a ratio air/gas>1 in the last or the two last zones.

Limiting the pre-heating temperature to lower than 600° C. is advantageous because it reduces the oxidation on the steel sheet. Moreover, it is particularly advantageous in a Radiant Tube Furnace (RTF) because it permits to avoid a potentially harmful selective oxidation.

During the heating step, the steel sheet is heated from a temperature T1 to a recrystallisation temperature T2 between 720° C. and 1000° C., at a heating rate being lower or equal to said maximal heating rate, in an atmosphere A1 comprising between 0.1 and 90% by volume of Hz, at least an inert gas and unavoidable impurities having a dew point $DP_1$ defined during the calibration step.

During the soaking step, said steel sheet is maintained in a temperature range from (T2−30° C.) to (T2+30° C.), in an atmosphere A2, comprising between 0.1 and 90% by volume of H2, at least an inert gas and unavoidable impurities, having a dew point $DP_2$ of at least −40° C. For example, if T2 is of 950° C., the steel is, in the soaking step iii), maintained in the temperature range from 920° C. to 980° C.

The atmospheres in the heating step and in the soaking step can be achieved by using preheated steam and incorporating $N_2$—$H_2$ gases in a furnace equipped with $H_2$ detectors in the different sections monitoring the atmosphere dew point temperature.

Preferably, said steel bulk chemical composition has a ratio, by weight percent, between manganese and silicon respecting: Mn/Si<4.

Preferably, said steel bulk chemical composition has a ratio, by weight percent, between aluminium and magnesium respecting: Mn/Al<1.

Preferably, said steel bulk chemical composition has a ratio, by weight percent, between manganese, aluminium and silicon respecting: Mn/(Al+(4×Si))<1.

All of the three preceding compositions permit to lower the formation of FeO—MnO at the steel surface and thus improve the coating adherence and homogeneity.

Preferably, in said pre-heating step i), said temperature T1 is lower than 550° C. Even more preferably, in said pre-heating step i), said temperature T1 is lower than 500° C. Apparently, limiting even more the temperature at the end of the pre-heating (T1), permits to reduce even lower the oxidation of the steel sheet. Moreover, it lowers the risk of potentially harmful selective oxidation in a RTF.

Preferably, in said pre-heating step i), the heating rate is above 50° $C.s^{-1}$. Increasing the heating rate in the pre-heating section permits to lower the length of this section and/or increase the productivity.

Preferably, in said heating step ii), said atmosphere A1 comprises between 1% and 20% by volume of H2 and at least an inert gas and unavoidable impurities. Even more preferably, in said heating step ii), said atmosphere A1 comprises between 3% and 8% by volume of H2 and at least an inert gas and unavoidable impurities.

Preferably, said heating step ii) lasts between 10 and 1000 seconds.

Preferably, in said soaking step iii), said steel sheet is maintained at a temperature from T2−10° C. to T2+10° C.

Preferably, said soaking step iii) lasts between 10 and 1000 seconds.

Preferably, in said soaking step iii), said atmosphere A1 comprises between 1% and 20% by volume of H2 and at least an inert gas and unavoidable impurities. Even more preferably, in said soaking step iii), said atmosphere A1 comprises between 3% and 8% by volume of H2 and at least an inert gas and unavoidable impurities.

Preferably, said coating bath is a zinc-based coating bath, also known as hot dip galvanizing, containing from 0.1 to 0.3 in weight percent of aluminium and optionally magnesium.

Preferably, said coating bath is an aluminium-based bath containing from 5 to 15 in weight percent of silicon.

Preferably, in said coating step C), said steel sheet is set at a temperature between 0° C. to 10° C. above a hot dip coating bath temperature being maintained at a temperature between 420° C. to 470° C.

Preferably, the coating bath of the step iv) of the calibration step A) and the coating bath of the coating step of the production step B) have a same base element.

Preferably, the coating bath of the step iv) of the calibration step A) and the coating bath of the coating step of the production step B) are zinc-based coating bath containing from 0.1 to 0.3 in weight percent of aluminium and optionally magnesium.

Preferably, the coating bath of the step iv) of the calibration step A) and the coating bath of the coating step of the production step B) are aluminium-based bath containing from 5 to 15 in weight percent of silicon.

A second set of experiment has been conducted to reproduce the calibration step of the claimed process and thus find $DP_1$. In this second set of experiments, an annealing cycle has been applied on a cold-rolled FeSi steel comprising 0.03 weight percent of carbon, 3 weight percent of silicon, 0.2 weight percent of Mn and 0.01 weight percent of aluminium. In this second set of experiments, all the parameters were constant except for the dew point in the heating section. T1 is of 600° C., the heating rate is of 20° $C.s^{-1}$, the dew point in the soaking zone is of −20° C., the $H_2$ concentration in the heating and soaking zones is of 5 volume percent and the soaking duration is of 37.5 seconds. The coating quality has been assessed visually. Four experiments were conducted for dew point $DP_{CAL}$ values of −10° C., −20° C., −25° C. and −30° C. according to the steps A)i) to A)v)a) of the claimed process. Then −25° C. was defined as $DP_1$ because it was the penultimate dew point of the calibration step, i.e. the last dew point where the coating quality was satisfying. The parameters are summed up in Table 2.

TABLE 2

| | Heating section | | | | Soaking section | | | | |
|---|---|---|---|---|---|---|---|---|---|
| Steel grade | T1 [°] | Heating rate [° C. · $s^{-1}$] | $DP_{CAL}$ [° C.] | H2 [%] | T2 [° C.] | $DP_2$ [° C.] | Duration [s] | H2 [%] | Coating quality |
| FeSi | 600 | 20 | −10 | 5 | 850 | −20 | 37.5 | 5 | Good |
| FeSi | 600 | 20 | −20 | 5 | 850 | −20 | 37.5 | 5 | Okay |
| FeSi | 600 | 20 | −25 | 5 | 850 | −20 | 37.5 | 5 | Okay |
| FeSi | 600 | 20 | −30 | 5 | 850 | −20 | 37.5 | 5 | Bad |

EXPERIMENTAL RESULTS

The following section deals with experimental results exhibiting the wettability of the steel in function of the parameters in the heating section.

A first set of experiments has been conducted to assess the influence of the T1 temperature on the coating quality. In this first set of experiments, an annealing cycle has been applied on a cold-rolled FeSi steel comprising 0.03 weight percent of carbon, 3 weight percent of silicon, 0.2 weight percent of Mn and 0.01 weight percent of aluminium. In this first set of experiments, all the parameters were constant except for T1. The heating rate is of 4.4° $C.s^{-1}$, the dew point in the heating and soaking zones is of −20° C., the $H_2$ concentration in the heating and soaking zones is of 5 volume percent and the soaking duration is of 37.5 seconds. The coating quality has been assessed visually. Three experiments were conducted for T1 values of 500° C., 600° C. and 700° C. The parameters are summed up in Table 1.

As it can be seen, all other parameters remaining constant when T1 is higher than 600° C., the coating quality is not satisfying. Moreover, all other parameters remaining constant it seems that smaller is T1, better is the coating quality.

TABLE 1

| | Heating section | | | | Soaking section | | | | |
|---|---|---|---|---|---|---|---|---|---|
| Steel grade | T1 [°] | Heating rate [° C. · $s^{-1}$] | DP [° C.] | H2 [%] | T2 [° C.] | DP [° C.] | Duration [s] | H2 [%] | Coating quality |
| FeSi | 500 | 4.4 | −20 | 5 | 850 | −20 | 37.5 | 5 | Good |
| FeSi | 600 | 4.4 | −20 | 5 | 850 | −20 | 37.5 | 5 | Okay |
| FeSi | 700 | 4.4 | −20 | 5 | 850 | −20 | 37.5 | 5 | Bad |

A third set of experiment was conducted to assess the reliability of the claimed process. In this third set of experiments, an annealing cycle has been applied on the same grade of cold-rolled FeSi steel as in the second set of experiment. In this third set of experiments, the calibration step defined $DP_1$ as −30° C. for a maximal heating rate of 10° $C.s^{-1}$. In this third set of experiments, all the parameters were constant except for the heating rate in the heating section. T1 is 600° C., the dew point in the heating zone is −30° C., the dew point in the soaking zone is −20° C., the $H_2$ concentration in the heating and soaking zones is 5 volume percent and the soaking duration is 37.5 seconds. The coating quality has been assessed visually. Three experiments were conducted for heating rate values of 10° $C.s^{-1}$, 9.5° $C.s^{-1}$ and 4.5° $C.s^{-1}$ according to the steps B)i) to B)iii) of the claimed process. The parameters are summed up in Table 3.

It can be observed that for any heating rate lower than the maximal heating rate in the heating zone, the coating quality is satisfying.

TABLE 3

| | Heating section | | | | Soaking section | | | | |
|---|---|---|---|---|---|---|---|---|---|
| Grade | T1 [°] | Heating rate [° C. · $s^{-1}$] | DP [° C.] | H2 [%] | T2 [° C.] | DP [° C.] | Duration [s] | H2 [%] | Coating quality |
| FeSi | 600 | 10 | −30 | 5 | 850 | −20 | 37.5 | 5 | Okay |
| FeSi | 600 | 9.5 | −30 | 5 | 850 | −20 | 37.5 | 5 | Okay |
| FeSi | 600 | 4.5 | −30 | 5 | 850 | −20 | 37.5 | 5 | Good |

What is claimed is:

1. A method for the manufacture of a steel sheet, having a thickness t, in a device having a pre-heating section, a heating section, having a maximal heating rate for a steel sheet having a thickness t and a soaking section, the method comprising:

A) a calibration step wherein i) a steel sheet having a thickness t and the following chemical composition in weight percent: 0.05≤C≤0.50%, 0.3≤Mn≤8.0%, 0.01≤Si≤5%, and optionally at least one of the following elements, in weight percent: 0.01≤Al≤1.5%, B≤0.004%, Co≤0.1%, 0.001≤Cr≤1.00%, Cu≤0.5%, 0.001≤Mo≤0.5%, Nb≤0.1%, Ni≤1.0%, Ti≤0.1%, N≤0.01%, P<0.1%, S≤0.01%, V<0.2%, a remainder of the composition being made of iron and inevitable impurities, is heated from room temperature to a temperature $T_1$ lower than 600° C., ii) the steel sheet is heated from Ti to a recrystallisation temperature $T_2$ in the range of 720° C. to 1000° C. at said maximal heating rate, in an atmosphere A1 including 0.1 to 90% by volume of $H_2$, the balance being an inert gas and unavoidable impurities and having a dew point $DP_{CAL}$, iii) the steel sheet is then maintained at a temperature $T_2$, in an atmosphere A2 including 0.1 to 90% by volume of $H_2$, the balance being an inert gas and unavoidable impurities and having a dew point of at least −40° C., iv) the steel sheet is then hot-dip coated in a coating bath and a quality of the coating is assessed, v) a) if the coating quality meets a predefined quality target, repeating the calibration steps i) to iv) with a lower dew point $DP_{CAL}$, until the coating quality no longer meets the target, a penultimate dew point $DP_{CAL}$ being defined as $DP_1$, b) if said coating quality is not satisfactory, repeating the calibration steps i) to v) with a higher dew point $DP_{CAL}$, until the coating quality meets the target, the ultimate $DP_{CAL}$ being defined as $DP_1$; and B) a production step wherein a steel sheet with the thickness t and the chemical composition undergoes:

a recrystallization annealing including successively a pre-heating step, a heating step, a soaking step and a cooling step wherein:

i) the pre-heating step includes a heating from room temperature to a temperature T1 lower than 600° C., ii) the heating step includes a heating from T1 to a recrystallisation temperature T2 in the range from 720° C. to 1000° C. at a heating rate being lower or equal to the maximal heating rate in an atmosphere A1 comprising 0.1 to 90% by volume of H2, the balance being an inert gas and unavoidable impurities and having a dew point set at least at the $DP_1$ value determined during the calibration step, iii) the soaking step including a holding at a temperature in the range from T2-30° C. to T2+30° C., in an atmosphere A2 comprising 0.1 to 90% by volume of H2, the balance being an inert gas and unavoidable impurities and having a dew point $DP_2$ set at −40° C. or more, and a coating step wherein the steel sheet is hot dip coated in the coating bath.

2. The method as recited in claim 1 wherein the chemical composition has a ratio, by weight percent, between manganese and silicon respecting: Mn/Si<4.

3. The method as recited in claim 1 wherein n the chemical composition has a ratio, by weight percent, between aluminium and magnesium respecting: Mn/Al<1.

4. The method as recited in claim 1 wherein the chemical composition has a ratio, by weight percent, between manganese, aluminium and silicon respecting: Mn/(Al+(4×Si)) <1.

5. The method as recited in claim 1 wherein in the pre-heating step i), the temperature T1 is lower than 550° C.

6. The method as recited in claim 5 wherein in the pre-heating step i), the temperature T1 is lower than 500° C.

7. The method as recited in claim 1 wherein in the pre-heating step i), the heating rate is above 50° C.$s^{-1}$.

8. The method as recited in claim 1 wherein in the heating step ii), said atmosphere A1 includes between 1 and 20% by volume of $H_2$, at least an inert gas and unavoidable impurities.

9. The method as recited in claim 1 wherein the heating step ii) lasts between 10 and 1000 seconds.

10. The method as recited in claim 1 wherein in said soaking step iii), the steel sheet is maintained at a temperature from (T2−10° C.) to (T2+10° C.).

11. The method as recited in claim 1 wherein the soaking step iii) lasts between 10 and 1000 seconds.

12. The method as recited in claim 1 wherein in the soaking step iii), the atmosphere A2 includes between 1 and 20% by volume of $H_2$, at least an inert gas and unavoidable impurities.

13. The method as recited in claim 12 wherein the coating bath is a zinc-based coating bath containing from 0.1 to 0.3 in weight percent of aluminium and optionally magnesium.

14. The method as recited in claim 12 wherein the coating bath is an aluminium-based bath containing from 5 to 15 in weight percent of silicon.

15. The method as recited in claim 1 wherein in the step ii) of the calibration step A) $DP_{CAL}$ has a lowest value of −40° C. and in said step v) a), if said coating quality is met at a $DP_{CAL}$ of −40° C., −40° C. is being defined as $DP_1$.

16. The method as recited in claim 1 wherein the coating bath of the step iv) of the calibration step A) and the coating bath of the coating step of the production step B) have a same base element.

17. The method as recited in claim 1 wherein the coating bath is a zinc-based coating bath containing from 0.1 to 0.3 in weight percent of aluminium and optionally magnesium.

18. The method as recited in claim 1 wherein the coating bath is an aluminium-based bath containing from 5 to 15 in weight percent of silicon.

* * * * *